US007297031B2

(12) United States Patent
Leddy

(10) Patent No.: US 7,297,031 B2
(45) Date of Patent: Nov. 20, 2007

(54) RE-CONFIGURABLE ELECTRICAL CONNECTORS

(75) Inventor: Thomas Leddy, Eastport, NY (US)

(73) Assignee: Advanced Testing Technologies, Inc., Hauppauge, NY (US)

( * ) Notice: Subject to any disclaimer, the term of this patent is extended or adjusted under 35 U.S.C. 154(b) by 0 days.

(21) Appl. No.: 11/453,660

(22) Filed: Jun. 15, 2006

(65) Prior Publication Data

US 2007/0128951 A1 Jun. 7, 2007

Related U.S. Application Data

(60) Provisional application No. 60/741,284, filed on Dec. 1, 2005.

(51) Int. Cl.
*H01R 13/502* (2006.01)

(52) U.S. Cl. ..... 439/701

(58) Field of Classification Search ..... 439/701, 439/532

See application file for complete search history.

(56) References Cited

U.S. PATENT DOCUMENTS 4,484,792 A * 11/1984 Tengler et al. ..... 439/578
4,519,667 A 5/1985 Canning et al.
4,662,705 A 5/1987 Prechtl et al.
5,386,518 A 1/1995 Reagle et al.
5,668,419 A 9/1997 Oktay
5,681,175 A 10/1997 Busse et al.
5,795,174 A * 8/1998 Saito et al. ..... 439/310
5,915,982 A 6/1999 Kashiyama et al.
5,964,602 A 10/1999 Aoki et al.
6,069,992 A 5/2000 Hyzin
6,102,746 A 8/2000 Nania et al.
6,155,850 A 12/2000 Martin et al.
6,168,445 B1 1/2001 Seutschniker et al.
6,217,354 B1 4/2001 Fencl et al.
6,241,539 B1 * 6/2001 Sato et al. ..... 439/157
6,305,957 B1 10/2001 Fink et al.
6,345,995 B1 2/2002 Bigotto et al.
6,354,852 B2 3/2002 Noro et al.
6,413,105 B2 7/2002 Noro et al.
6,461,177 B1 10/2002 Saka et al.
6,464,546 B2 10/2002 LaCoy
6,824,406 B1 11/2004 Sharples et al.
6,848,922 B2 2/2005 Coughlan et al.
2004/0060725 A1 4/2004 Behziz et al.
2004/0157499 A1 8/2004 Nania et al.

OTHER PUBLICATIONS

Aldo Bruni, "Latching Mechanism for Plug and Socket Type Electrical Connector," abstract of EP0363804, Apr. 18, 1998.

* cited by examiner

*Primary Examiner*—Tulsidas C. Patel
*Assistant Examiner*—Phuongchi Nguyen
(74) *Attorney, Agent, or Firm*—Brian Roffe

(57) ABSTRACT

Re-configurable electrical connector including a pair of endcaps, a pair of elongate rails, each removably attached at one end to one of the endcaps, and connector modules arranged between the endcaps and including one or more male or female connecting members adapted to electrically connect at a first end to one electrical component or part thereof and at a second, opposite end to another electrical component or part thereof. The connector modules are individual modules in the sense that they are separated from one another. When the rails are detached from the endcaps, each connector module can be moved relative to the rails, i.e., slid off of the end of the rails, to enable different configurations of connector modules to be positioned between the endcaps.

25 Claims, 7 Drawing Sheets

RE-CONFIGURABLE ELECTRICAL CONNECTORS

CROSS REFERENCE TO RELATED APPLICATION

This application claims priority under 35 U.S.C. §119(e) of U.S. provisional patent application Ser. No. 60/741,284 filed Dec. 1, 2005, the entire contents of which are incorporated by reference herein.

FIELD OF INVENTION

The present invention relates generally to electrical connectors which connect electrical components together and more particularly to electrical connectors which can be adjusted to provide for different configurations of connecting members so that the connectors can be used with different electrical components.

BACKGROUND OF INVENTION

Electrical connectors are needed to connect electrical components together. As used herein, electrical components include cables, wires, patch panels and the like. Each connector is typically provided with a fixed configuration of male or female connecting members which enables it to connect only to an electrical component with the complementary configuration of connecting members. There is therefore no flexibility to use the same connector to connect to two or more electrical components having different configurations of connecting members.

It would be beneficial if a single connector were able to be re-configurable to connect to electrical components having different configurations of connecting members.

OBJECTS AND SUMMARY OF INVENTION

It is an object of the present invention to provide new and improved electrical connectors which connect electrical components together.

It is another object of the present invention to provide new and improved electrical connectors which are adjustable to provide different configurations of connecting members so that the same connectors can be used with electrical components having different configurations of connecting members.

It is yet another object of the present invention to provide new and improved electrical connectors which are re-configurable to connect to electrical components having different configurations of connecting members.

In order to achieve these objects and others, one embodiment of an electrical connector in accordance with the invention includes a pair of endcaps, a pair of elongate rails, each removably attached at one end to one of the endcaps (and possibly removably attached at each end to a respective endcap), and connector modules arranged between the endcaps and including one or more male or female connecting members adapted to electrically connect at a first end to one electrical component or connecting member thereof and at a second, opposite end to another electrical component or connecting member thereof. The connector modules are individual modules in the sense that they are separated from one another and movable relative to one another. When the rails are attached to the endcaps, the connector modules are fixed in position by the attachment of the rails to the endcaps, but when the rails are separated or detached from the endcaps, each connector module can be moved relative to the rails, i.e., slid off of the end of the rails. By arranging different numbers and types of connector modules along the rails between the endcaps, different configurations of connector modules and thus different connectors can be provided.

More specifically, in one configuration of the connector modules, all of the connector modules are identical and include a pre-determined number of male connecting members, e.g., pins, or female connecting members, e.g., sockets. To obtain a different configuration of connector modules, one or more of the connector modules is removed and replaced with a connector module having a different number of connecting members or possibly even with a blank, i.e., a module without any connecting members. Replacement of the connector modules(s) would be performed when the connector is intended to be used to connect to a different electrical component, i.e., an electrical component having a different complementary configuration of connecting members. Thus, when the connector modules are all identical, the connector connects to one electrical component and when the connector modules are not all identical, the connector connected to a second, different electrical component.

By selecting particular connector modules and their relative position between the endcaps and/or orientation relative to the endcaps, numerous different configurations of connectors can be obtained. Moreover, changing between connector configurations is easy to perform as it entails simply separating or detaching the rails from the endcaps, moving one or more of the connector modules out of engagement with the rails, placing connector modules in the new, desired order and in engagement with the rails, and then re-attaching the rails and the endcaps together.

The endcaps may be different depending on whether the connector is used in a fixture or a receiver. In the former case, the fixture includes male endcaps each having a pair of coupling members oriented so that a projecting portion thereof is in the same direction as the mating surface whereas in the latter case, the receiver includes female endcaps each having a pair of similar coupling members oriented so that a recessed portion thereof is in the same direction as the mating surface.

One particularly useful configuration of a female connector in accordance with the invention is one in which the connector is adapted for connection to a Virginia Panel Series 90 patch panel and wherein there are 480 Hypertronics contacts arranged in 48 connector modules each including 10 sockets. Another useful configuration is one in which the female connector is adapted for connection to a Mac Panel 60 RFI patch panel and wherein there are 500 Hypertronics contacts arranged in 50 connector modules each including 10 sockets.

To provide for engagement between the endcaps and the rails, each endcap includes a pair of channels on each side and each rail includes a pair of elongate projections having a form substantially complementary to the form of the channels, e.g., a dovetail form. Each projection on the rail is slidable into and along a respective channel on a respective side of the endcaps. That is, on each side of each endcap, there are two channels and each channel aligns with a respective one of the channels on the same side of the other endcap. One projection on the rail engages with each aligning pair of channels.

Screws or another attachment mechanism are used to removably attach the rails to the endcaps. Such screws may be placed at one or both ends of the rails so that the rails can be removably attached to only one endcap or to both endcaps.

A dielectric housing of the connector modules is also provided with a channel on each side having a form complementary to the form of one of the projections on the rail. Accordingly, in its assembled form, this projection on each rail is situated within the channel on a respective side of the housings of the connector modules to thereby secure the connector modules in place between the endcaps.

Another way to consider the electrical connector in accordance with the invention is as a connector having individual connector modules each including at least one male or female connecting member adapted to electrically connect at a first end to a first electrical component or connecting member thereof and at a second, opposite end to a second electrical component or connecting member thereof, a pair of elongate rails and a pair of endcaps. Each connector module engages at one side with one rail and at an opposite side with the other rail. Each rail is removably attached at one end to one of the endcaps, and possibly at each end to a respective endcap. When the rails are separated or detached from the endcap(s), different configurations of connector modules are positionable between the endcaps, to thereby form different connectors in a similar manner as described above.

Yet another way to consider an electrical connector in accordance with the invention is as a connector including a frame having a plurality of side members defining an interior space, at least a first side member being detachable from any remaining side members (or assembly thereof) to enable access to the interior space. The side members could be the endcaps and rails described above, with one of the endcaps being detachable from the remaining assembly of the rails and other endcap, or may be other forms of rigid members which cooperate to define a border around an interior space. Connector modules are arranged in the interior space defined by the side members. The connector modules are separated from one another and each includes at least one male or female connecting member adapted to electrically connect at a first end to a first electrical component or part thereof and at a second, opposite end to a second electrical component or part thereof. Each connector module is movable relative to any remaining side members (or assembly thereof) when the first side member is detached therefrom to enable different configurations of connector modules to be arranged in the interior space.

Other objects and advantages of the present claimed invention and inventions disclosed below are set forth below and others will become apparent from the following description of preferred embodiments taken in conjunction with the accompanying drawings.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
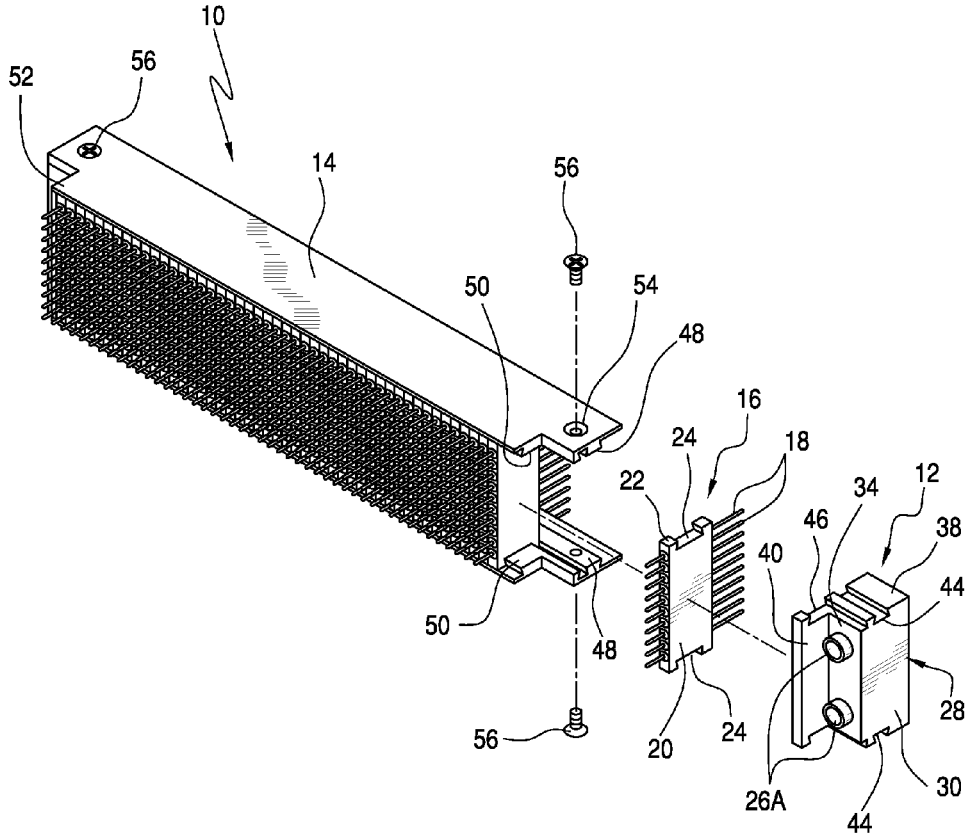
FIG. 1 is a perspective view of a first embodiment of a connector in accordance with the invention.
Figure 2:
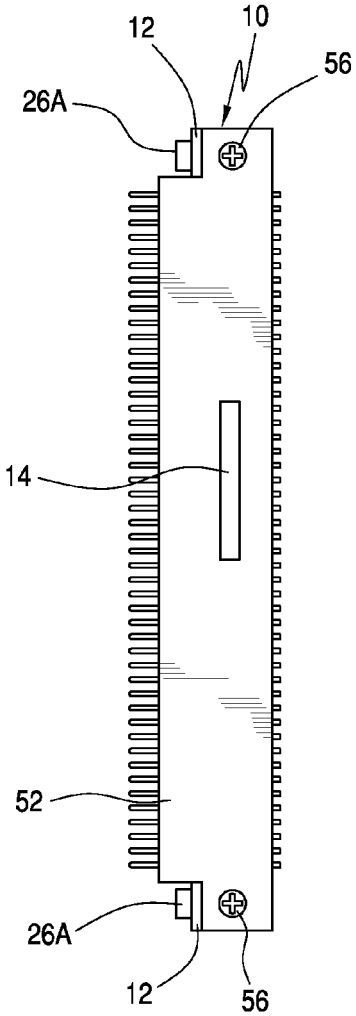
FIG. 2 is a side view of the connector shown in FIG. 1.
Figure 3:
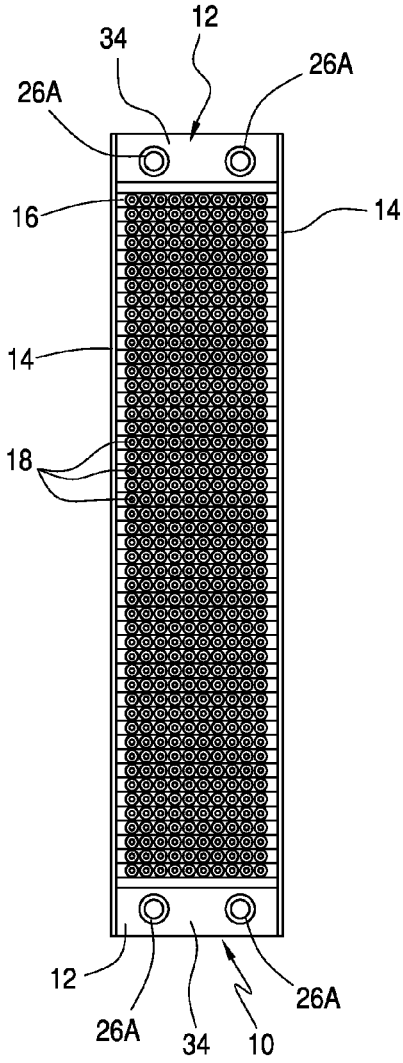
FIG. 3 is a front view of the connector shown in FIG. 1.

Referring to the accompanying drawings wherein like reference numerals refer to the same or similar elements, a first embodiment of an electrical connector in accordance with the invention is shown in FIGS. 1-10 and is designated generally as 10. Connector 10 includes a pair of endcaps 12, a pair of elongate rails 14 attached at their ends to the endcaps 12 and a plurality of connector modules 16 arranged between the endcaps 12 and in engagement with the rails 14.

Figure 9:
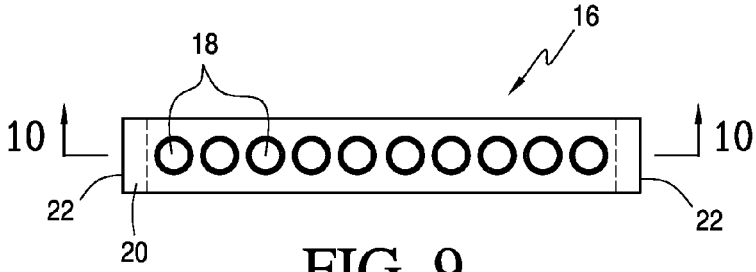
FIG. 9 is a front view of the connector module shown in FIG. 8.
Figure 10:
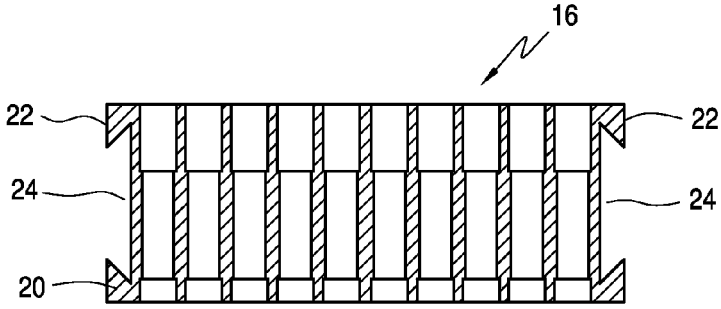
FIG. 10 is a view taken along the line 10-10 of FIG. 9.
Figure 11:
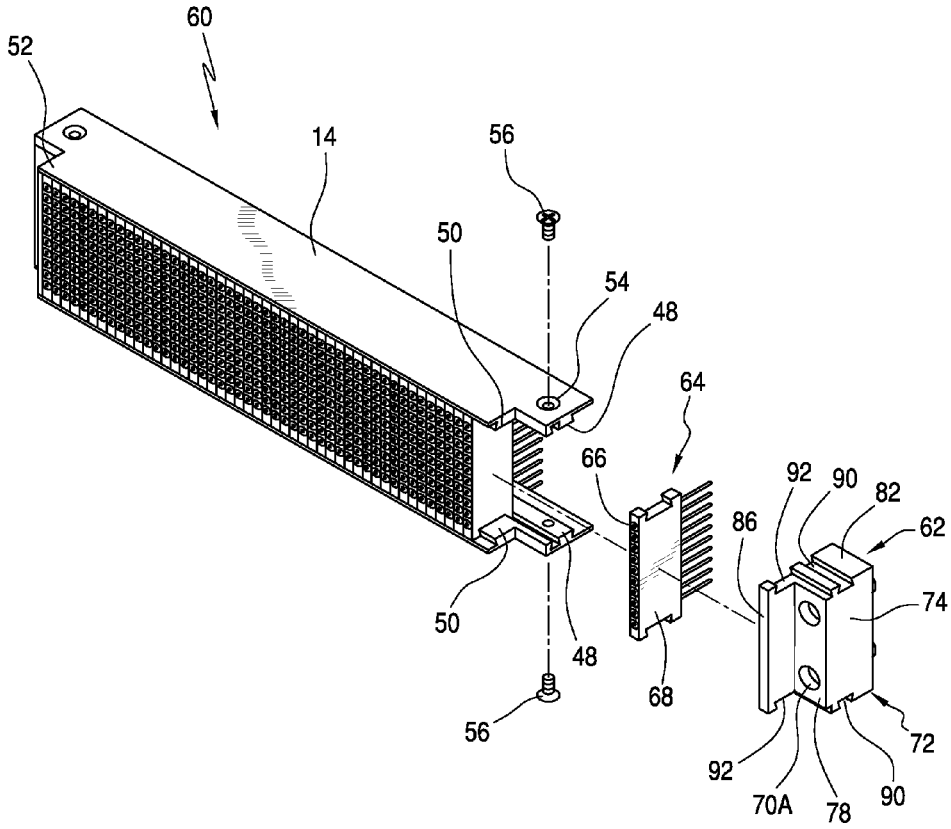
FIG. 11 is a perspective view of a second embodiment of a connector in accordance with the invention.
Figure 12:
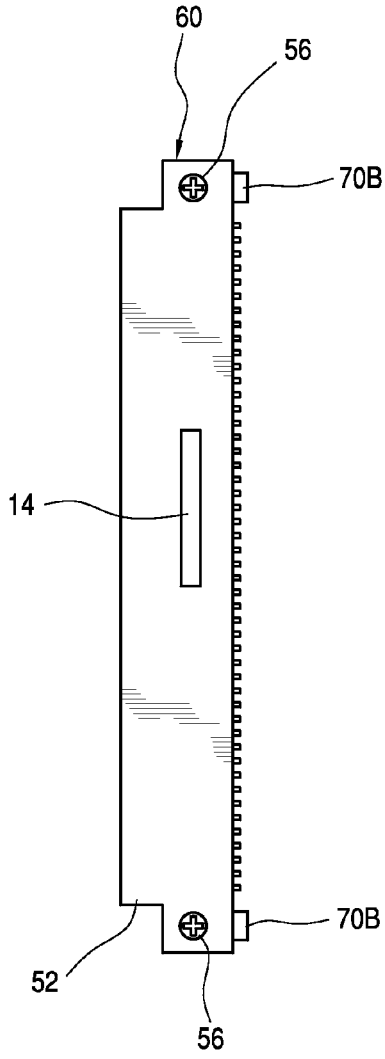
FIG. 12 is a side view of the connector shown in FIG. 11.
Figure 13:
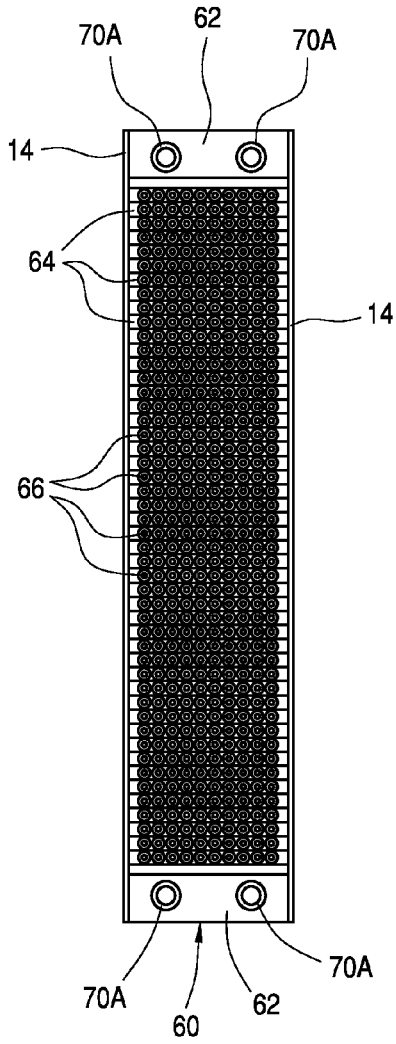
FIG. 13 is a front view of the connector shown in FIG. 11.

Connector 10 is a male connector in the sense that the connector modules 16 all include only male connecting members, specifically pins 18 (see FIGS. 9 and 10). Pins can be any known type of pins used in electrical connectors but in a preferred embodiment, the pins are Hypertronics pins designated YPN006-046H-A81, although other 0.024 round pins could be used as well. Pins 18 are held in place by a dielectric housing 20 to form each connector module 16. Each pin 18 includes connecting projections each extending from a respective side of the housing 20. Each lateral side 22 of the housing 20 includes a channel 24 in the form of a dovetail groove (see FIGS. 8 and 10).

Figure 4:
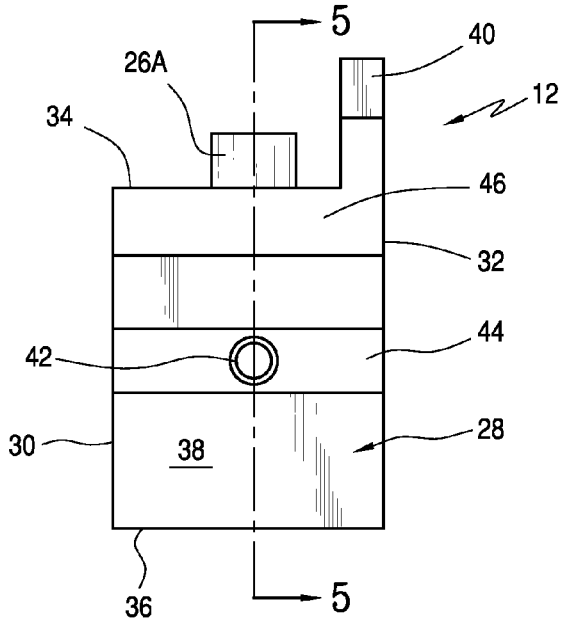
FIG. 4 is a side view of an endcap of the connector shown in FIG. 1.
Figure 5:
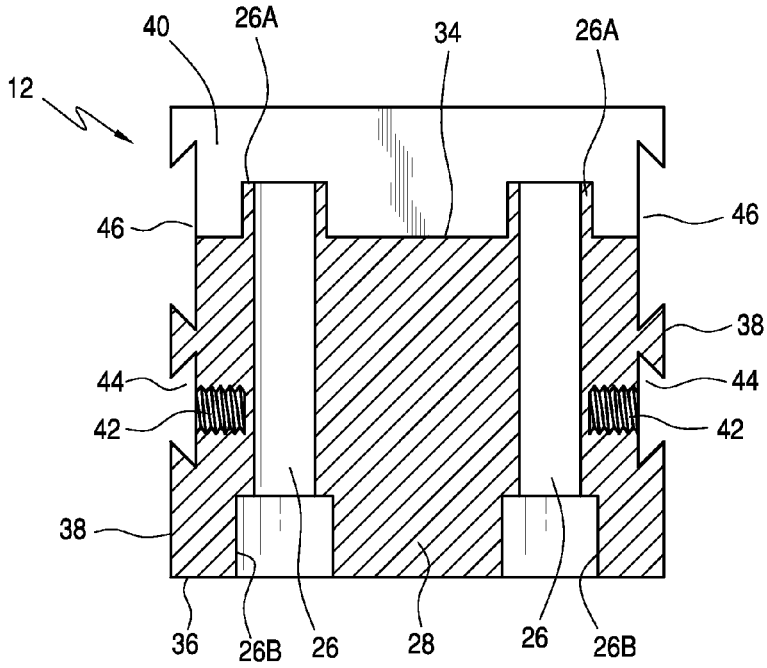
FIG. 5 is a view taken along the line 5-5 of FIG. 4.

Endcaps 12 are male endcaps in the sense that they include a pair of coupling members 26 having projections 26A oriented in the same direction as the pins 18 (i.e., in the direction of the mating surface) and recesses 26B on an opposite side (see FIGS. 1, 4 and 5). Projections 26A of the coupling members 26 are designed to mate with a complementary female coupling recess on another electrical component.

With reference in particular to FIGS. 4 and 5, endcaps 12 each have a housing 28 having a front side 30, a rear side 32, a top 34, a bottom 36 and lateral sides 38. Projections 26A project from the top 34. A flange 40 also extends upward at a rear of the housing 28 from the top 34 and has a rear surface contiguous with the rear side 32. Screw holes 42 are formed in the lateral sides 38, the purpose of which is explained below. Lateral sides 38 each include a channel 44, and an additional, larger channel 46 is formed partially in the lateral side 38 and partially on the side of the flange 40.

Figure 6:
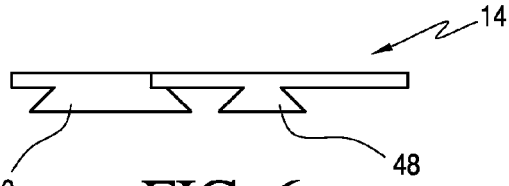
FIG. 6 is a top view of a rail of the connector shown in FIG. 1.
Figure 7:
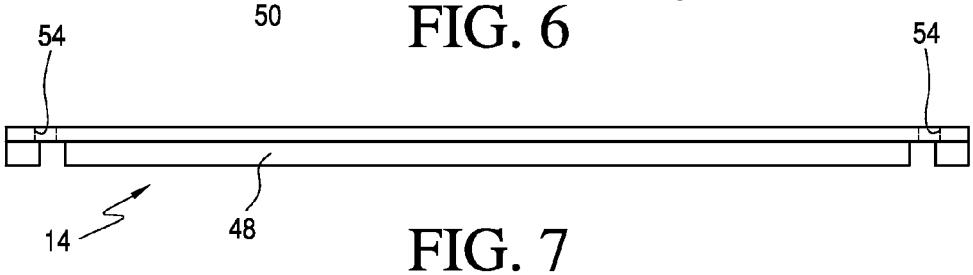
FIG. 7 is a front view of a rail of the connector shown in FIG. 1.
Figure 8:
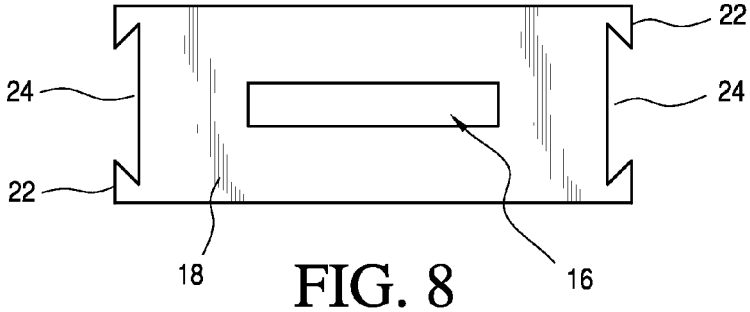
FIG. 8 is a top view of a connector module of the connector shown in FIG. 1.

Rails 14 each include a first projection 48 on an inner side extending along substantially the entire length of the rail 14 and a second projection 50 along the inner side extending along substantially the entire length of a stepped portion 52 of the rail 14 (see FIGS. 6 and 7). Projection 50 is wider than projection 48, although different relative sizes of these projections 48, 50 can be provided.

Apertures 54 are provided proximate the longitudinal ends of the rails 14 and align with the screw holes 42 in the sides 38 of the housing 28 of the endcaps 12 (see FIG. 7). Screws 56 can therefore be inserted through apertures 54 into screw holes 42 and tightened to thereby secure the rails 14 at their longitudinal ends to the endcaps 12. Instead of screws, other attachment mechanisms which enable the rails 14 to be selectively attachable to and detachable from the endcaps 12 can be provided in the invention without deviating from the scope and spirit thereof.

Projections 48, 50 have a form, i.e., size and shape, substantially complementary to the form of channels 44, 46, respectively, on the housing 28 of the endcaps 12. As such, the endcaps 12 can be engaged with the rails 14 by aligning the projections 48, 50 on the rails 14 with the channels 44, 46, respectively, on the endcaps 12 and sliding them into the respective channel 44, 46.

To assemble connector 10, one end of each rail 14 is attached to one endcap 12, one rail 14 on each side of the endcap 12, by inserting the projections 48, 50 on the rail 14 into the respective channel 44, 46 on the housing 28 of the endcap 12. Screws 56 are then inserted through apertures 54 into screw holes 42 and tightened. Connector modules 16 are selected for the particular use of the connector 10, e.g., 48 of the connector modules 16 as shown, and each is slid along the rails 14 by aligning the projection 50 on the rails 14 with the channels 24 on the lateral sides 22 of the housing 20. Once the desired connector modules 16 are engaged with the rails 14 attached to one endcap 12, the other endcap 12 is engaged with the rails 14 by aligning the projections 48, 50 with the channels 44, 46 in the housing 28 of the endcap 12. Screws 56 are then inserted through apertures 54 into screw holes 42 in this second endcap 12 and tightened to thereby form connector 10.

If and when it is desired to reconfigure connector 10, the rails 14 are detached from one of the endcaps 12 by loosening the screws 56 and removing them from the screw holes 42 and apertures 54. The endcap 12 is then slid off of the rails 14 and the connector modules 16 are then also slidable off of the rails 14. The different connector modules 16 sought to be used for the re-configured connector are then placed in engagement with the rails 14 in the desired order and once all of the connector modules 16 are in place, the endcap 12 and rails 14 are re-attached to one another. When reconfiguring the connector 10, it is not required to detach both endcaps 12 from the rails 14 but rather only one of the endcaps 12 needs to be detached from the rails 14 to enable removal and replacement of the connector modules 16.

In the embodiments described above, the combination of the endcaps 12 and rails 14 defines a frame with a plurality of side members, at least one of which is separable from the remaining side members. During use of the connector 10, this separable side member (either of the endcaps 12) is fixed to the other side members (the rails 14 which in turn are fixed to the other one of the endcaps 12) but when it is desired to re-configure the connector 10, this separable side member is detached from the other side members to allow access to the interior of the frame, i.e., to allow the connector modules 16 in the interior of the frame to be removed and replaced as desired. Instead of endcaps 12 and rails 14, other constructions for defining such a frame with an accessible interior are envisioned to be within the scope and spirit of the invention. For example, the frame could be defined by only two side members, namely, a U-shaped side member and an elongate side member which closes the opening of the U-shaped member and is removably attached thereto.

Referring now to FIGS. 11-16, a second embodiment of an electrical connector in accordance with the invention is designated generally as 60 and includes a pair of endcaps 62, a pair of elongate rails 14 as described above and a plurality of connector modules 64 arranged between the endcaps 62 and in engagement with the rails 14.

Figure 16:
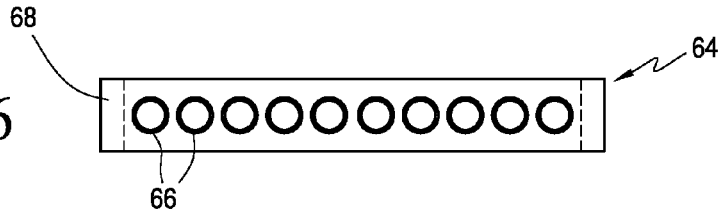
FIG. 16 is a top view of a connector module of the connector shown in FIG. 11.

Connector 60 is a female connector in the sense that the connector modules 64 all include only female connecting members, specifically sockets 66 (see FIG. 16). Sockets 66 can be any known type of sockets used in electrical connectors but in a preferred embodiment, the sockets are Hypertronics part number YSK006-031AH-A81. Sockets 66 are held in place by a dielectric housing 68 to form each connector module 64. Each socket 66 includes a receptacle at one end and a connecting projection extending from the housing 68 at the other. Each lateral side of the housing 68 includes a channel in the form of a dovetail groove in a similar manner as housing 20 of connector module 16 includes a channel 24 in the form of a dovetail groove.

Figure 14:
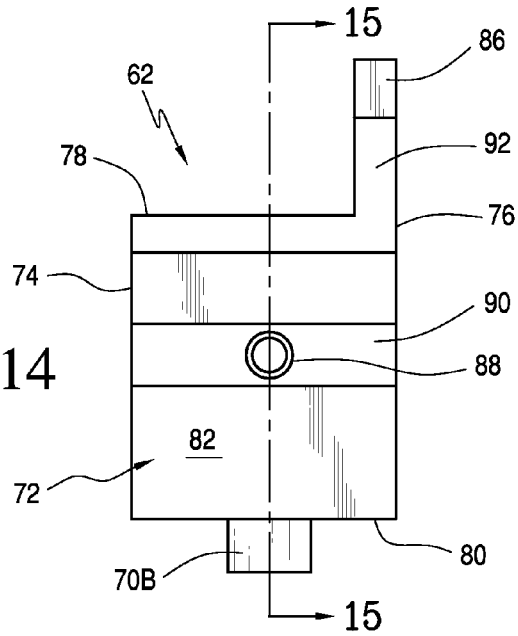
FIG. 14 is a side view of an endcap of the connector shown in FIG. 11.
Figure 15:
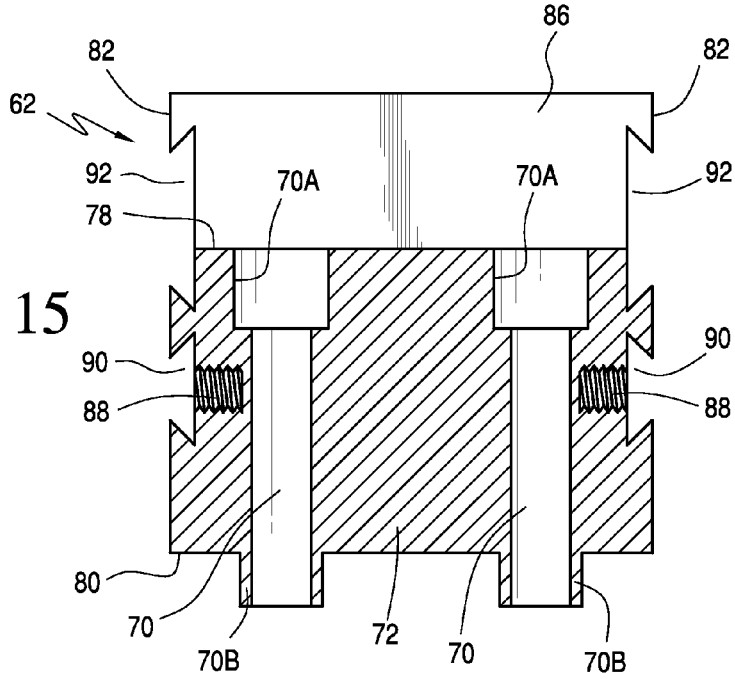
FIG. 15 is a view taken along the line 15-15 of FIG. 14.

Endcaps 62 are female endcaps in the sense that they include a pair of coupling members 70 having a receptacle or recess 70A oriented inward in the same direction as the sockets 66 (i.e., in the direction of the mating surface) and a projection 70B on an opposite side (see FIGS. 14 and 15). Recesses 70A are designed to accept a screw to fasten the connector 60 to, for example, a Virginia Panel Series 90 patch panel. Projections 70B are designed to mate with a complementary female coupling (or recess) on the patch panel.

Endcaps 62 each have a housing 72 having a front side 74, a rear side 76, a top 78, a bottom 80 and lateral sides 82. A flange 86 extends upward at a rear of the housing 72 from the top 78 and has a rear surface contiguous with the rear side 76. Screw holes 88 are formed in the lateral sides 82, the purpose of which is explained below. Lateral sides 82 each include a channel 90 and an additional, larger channel 92 is formed partially in the lateral side 82 and partially on the side of the flange 86.

Channels 90, 92 have a form, i.e., size and shape, substantially complementary to the form of projections 48, 50, respectively, on the rails 14. As such, the endcaps 62 can be engaged with the rails 14 by aligning the projections 48, 50 on the rails 14 with the channels 90, 92, respectively, on the endcaps 12 and sliding them into the respective channel 90, 92.

To assemble connector 60, one end of each rail 14 is attached to one endcap 62, one rail 14 on each side of the endcap 62, by inserting the projections 48, 50 on the rail 14 into the respective channel 90, 92 on the housing 72 of the endcap 62. Screws 56 are then inserted through apertures 54 into screw holes 88 and tightened. Connector modules 64 are selected for the particular use of the connector 10, e.g., 48 of the connector modules 64 as shown, and each is slid along the rails 14 by aligning the projection 50 on the rails 14 with the channels on the lateral sides of the housing 68. Once the desired connector modules 64 are engaged with the rails 14 attached to one endcap 62, the other endcap 62 is engaged with the rails 14 by aligning the projections 48, 50 with the channels 90, 92 in the housing 72 of the endcap 62. Screws 56 are then inserted through apertures 54 into screw holes 88 in this second endcap 62 and tightened to thereby form connector 60.

If and when it is desired to reconfigure connector 60, the rails 14 are detached from one of the endcaps 62 by loosening the screws 56 and removing them from the screw holes 88 and apertures 54. The endcap 62 is then slid off of the rails 14 and the connector modules 64 are then also slidable off of the rails 14. The different connector modules 64 sought to be used for the re-configured connector are then placed in engagement with the rails 14 in the desired order and once all of the connector modules 64 are in place, the endcap 62 and rails 14 are re-attached to one another. When reconfiguring the connector 60, it is not required to detach both endcaps 62 from the rails 14 but rather only one of the endcaps 62 needs to be detached from the rails 14 to enable removal and replacement of the connector modules 64.

The illustrated connector modules 16, 64 include ten, identical pins 18 or ten, identical sockets 66. Alternative connector modules 16, 64 can be used in the invention provided each has the same general form of housing, i.e., a channel on each side which can engage with one of the projections on the rails 14. For example, possible connector modules include one which has a different number of male connecting members, one which has different male connecting members (i.e., different types of pins alongside one another), and one which could conceivably have both a male and a female connecting member. In one embodiment, different pins are used depending on the signal intended to be used, i.e., the signal being conveyed through the connector. Of course, whatever configuration is used for one connector must have a complementary configuration in an electrical component to which the connector is to be mated. Typically, the existence of electrical components with known connecting member configurations will determine the manner in which the connector modules will be assembled in a connector in accordance with the invention.

In connectors 10, 60, the coupling members 26 and 70 are shown mounted onto the endcaps 12, 62, respectively, and this is designed to ensure that the connectors 10, 60 align properly into the mating receiver or fixture. In a similar manner, the receiver and fixture also have alignment points that ensure that they mate properly.

It is conceivable that in some connectors in accordance with the invention, there may be blank modules which do not contain any connecting members. Such blank modules could serve to position other connecting modules at desired locations intermediate the endcaps 12.

Regarding the material composition of the connectors 10, 60, the rails 14 and endcaps 12, 62 can be made of a metal, such as aircraft-grade aluminum, which provides them with an acceptable level of rigidity for use (which level would be understood or readily determinable by those skilled in the art). The connector modules 16, 64 are made of a material selected based on its electrical properties, such as glass-filled nylon.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although in the illustrated embodiment, the rails includes two projections and endcaps include two complementary channels, it is possible to form the rails with only one projection in which case, this projection would pass through a single channel formed in the endcap housings and also through the single channel formed in the connector module housings.

The invention claimed is:

1. An electrical connector for removable attachment to a plurality of different electrical connectors, comprising:

first and second endcaps;

first and second elongate rails, each of said first and second rails being removably attached at one end to one of said first or second endcap; and a plurality of connector modules arranged between said first and second endcaps, said connector modules being separable from one another and each including at least one male or female connecting member adapted to electrically connect at a first end to a first electrical component or part thereof and at a second, opposite end to a second electrical component or part thereof, each of said connecting members including a single projection at the first end for removably engaging with the first electrical component or part thereof and a single projection or a single receptacle at the second end for removably engaging with the second electrical component or part thereof, each of said connector modules being movable relative to said first and second rails when said first and second rails are detached from said first or second endcap to enable different configurations of connector modules to be positioned between said first and second endcaps and thereby provide for removable engagement with a plurality of different first electrical components and a plurality of different second electrical components.

2. The connector of claim 1, wherein said first and second endcaps each include a pair of channels on each side, said first and second rails each including a pair of elongate projections, each of said projections being slidable into and along a respective one of said channels on a respective side of said first and second endcaps, said connector modules each including a channel on each side, one of said projections on each of said first and second rails being slidable into and along said channel of said connector modules.

3. The connector of claim 1, wherein said first and second endcaps each include at least one channel on each side, said first and second rails each including at least one elongate projection, each of said at least one projection being slidable into and along a respective one of said at least one channel on a respective side of said first and second endcaps.

4. The connector of claim 1, wherein said connector modules each include a plurality of male or female connecting members and a dielectric housing, at least a part of each of said connecting members being fixed in said housing and isolated from other of said connecting members in said housing.

5. The connector of claim 1, wherein said first and second rails are removably attached at a first end to said first endcap, each of said connector modules being movable relative to said first and second rails when said first and second rails are detached from said first endcap.

6. The connector of claim 1, wherein said connector is a female connector and said connector modules include only sockets which constitute said female connecting members, said sockets having the single receptacle at the second end.

7. The connector of claim 6, wherein said first and second endcaps are female endcaps each including a pair of coupling members having receptacles recessed in the same direction as said receptacles at the second end of said sockets.

8. The connector of claim 7, wherein said sockets said connecting members have a unitary construction and provide a single electrical path between the first electrical component or part thereof engaging with the single projection at the first end and the second electrical component or part thereof engaging with the single projection or the single receptacle at the second end.

9. The connector of claim 1, wherein said connector is a male connector and said connector modules include only pins which constitute said male connecting members, said pins having the single projection at the second end.

10. The connector of claim 9, wherein said pins are round pins.

11. The connector of claim 9, wherein said first and second endcaps are male endcaps each including a pair of coupling members having projections oriented in the same direction as said projections at the first end of said pins.

12. The connector of claim 9, wherein said plurality of connector modules comprises 48 connector modules or 50 connector modules.

13. An electrical connector for attachment to a plurality of different electrical components, comprising:

a plurality of individual connector modules each including at least one male or female connecting member adapted to electrically connect at a first end to a first electrical component or part thereof and at a second, opposite end to a second electrical component or part thereof, each of said connecting members including only a single projection at the first end for engaging with the first electrical component or part thereof and only a single projection or only a single receptacle at the second end for engaging with the second electrical component or part thereof;

first and second elongate rails, each of said connector modules engaging at one side with said first rail and at an opposite side with said second rail; and first and second endcaps, each of said first and second rails being removably attached at one end to one of said first or second endcap such that when said first and second rails are detached from said first or second endcap, different configurations of connector modules are positionable between said first and second endcaps and thereby provide for removable engagement with a plurality of different first electrical components and a plurality of different second electrical components.

14. The connector of claim 13, wherein each of said connector modules is movable relative to said first and second rails when said first and second rails are detached from said first or second endcap.

15. The connector of claim 13, wherein said first and second endcaps each include a pair of channels on each side, said first and second rails each including a pair of elongate projections, each of said projections being slidable into and along a respective one of said channels on a respective side of said first and second endcaps, said connector modules each including a channel on each side, one of said projections on each of said first and second rails being slidable into and along said channel of said connector modules.

16. The connector of claim 13, wherein said connector modules each include a plurality of male or female connecting members and a dielectric housing, at least a part of each of said connecting members being fixed in said housing.

17. The connector of claim 13, wherein said connector is a female connector and said connector modules include only sockets which constitute said female connecting members, said sockets having the single receptacle at the second end.

18. The connector of claim 17, wherein said first and second endcaps are female endcaps each including a pair of coupling members having receptacles recessed in the same direction as said receptacles at the second end of said sockets.

19. The connector of claim 13, wherein said first and second rails are removably attached at a first end to said first endcap, each of said connector modules being movable relative to said first and second rails when said first and second rails are detached from said first endcap.

20. The connector of claim 19, wherein said first and second rails are removably attached at a second end to said second endcap, each of said connector modules being movable relative to said first and second rails when said first and second rails are detached from said second endcap.

21. The connector of claim 13, wherein said connector is a male connector and said connector modules include only pins which constitute said male connecting members, said pins having the single projection at the second end.

22. The connector of claim 21, wherein said first and second endcaps are male endcaps each including a pair of coupling members having projections oriented in the same direction as said projections at the first end of said pins.

23. The connector of claim 21, wherein said plurality of connector modules comprises 48 connector modules or 50 connector modules.

24. The connector of claim 5, wherein said first and second rails are removably attached at a second end to said second endcap, each of said connector modules being movable relative to said first and second rails when said first and second rails are detached from said second endcap.

25. An electrical connector for removable attachment to a plurality of different electrical connectors, comprising:

a frame including a plurality of side members defining an interior space, at least a first one of said side members being detachable from any remaining side members to enable access to said interior space; and a plurality of connector modules arranged in said interior space defined by said side members, said connector modules being separated from one another and each including at least one male or female connecting member adapted to electrically connect at a first end to a first electrical component or part thereof and at a second, opposite end to a second electrical component or part thereof, each of said connecting members including a single projection at the first end for removably engaging with the first electrical component or part thereof and a single projection or a single receptacle at the second end for removably engaging with the second electrical component or part thereof, each of said connector modules being movable relative to said any remaining side members when said first side member is detached from said any remaining side members to enable different configurations of connector modules to be arranged in said interior space and thereby provide for removable engagement with a plurality of different first electrical components and a plurality of different second electrical components.

* * * * *